US005562088A

United States Patent [19]

Valters et al.

[11] Patent Number: 5,562,088

[45] Date of Patent: Oct. 8, 1996

[54] TERMINATION DEVICE FOR HORIZONTAL DIRECT VENT GAS FIREPLACES OR THE LIKE

[75] Inventors: Tim Valters, Burlington; Dan Perz, Hamilton; Joseph Yeremian, Scarborough, all of Canada

[73] Assignee: GSW Inc., Toronto, Canada

[21] Appl. No.: 377,624

[22] Filed: Jan. 25, 1995

[51] Int. Cl.[6] ..... F23L 17/04

[52] U.S. Cl. ..... 126/85 B; 454/8

[58] Field of Search ..... 126/85 B; 454/8

[56] References Cited

U.S. PATENT DOCUMENTS

| | | | |
|---|---|---|---|
| 3,382,860 | 5/1968 | Cooper et al. | 126/85 B X |
| 3,659,560 | 5/1972 | Carter | 126/85 B X |
| 4,651,710 | 3/1987 | Hénault | 126/85 B |

FOREIGN PATENT DOCUMENTS

| | | | |
|---|---|---|---|
| 2528350 | 7/1976 | Germany | 126/85 B |
| 310222 | 12/1989 | Japan | 454/8 |

*Primary Examiner*—Harold Joyce

[57] ABSTRACT

A termination device for a through the wall connection to the double walled coaxial ducting of a horizontal direct vented gas fireplace or the like comprising a mounting means having an opening therethrough for mounting said device on the exterior of a wall having a passage therethrough with the opening registering with the passage, a first pipe adapted for connection with the outer of the coaxial ducts secured to the mounting means and projecting inwardly thereof and adapted to extend through the wall passage, deflector means supported in spaced relation outwardly from the mouth of the first pipe and presenting an air deflecting surface formation surrounding and sloping inwardly towards the mouth of the first pipe to a central opening in substantially coaxial relation with but spaced from the first pipe, said air deflecting surface formation being adapted to deflect air inwardly into the first pipe, a second pipe adapted for connection with the inner of the coaxial ducts extending from an outer end located on the outer side of the deflecting surface formation inwardly through the deflector surface central opening and through the first pipe, means being provided to bar the entrance of foreign objects into the mouth of the first pipe while permitting airflow therethrough, and protective means surrounding the outer end of the second pipe being provided to bar access thereto while permitting escape of exhaust fumes. Preferably the outer end of the second pipe terminates in a cap having a series of peripheral openings therearound and the means surrounding the second pipe comprises a generally spherical chamber having a central band of screening for outletting exhaust products, the inner portion of the chamber facing the mounting plate constituting the air deflecting surface formation.

6 Claims, 2 Drawing Sheets

FIG. 3.
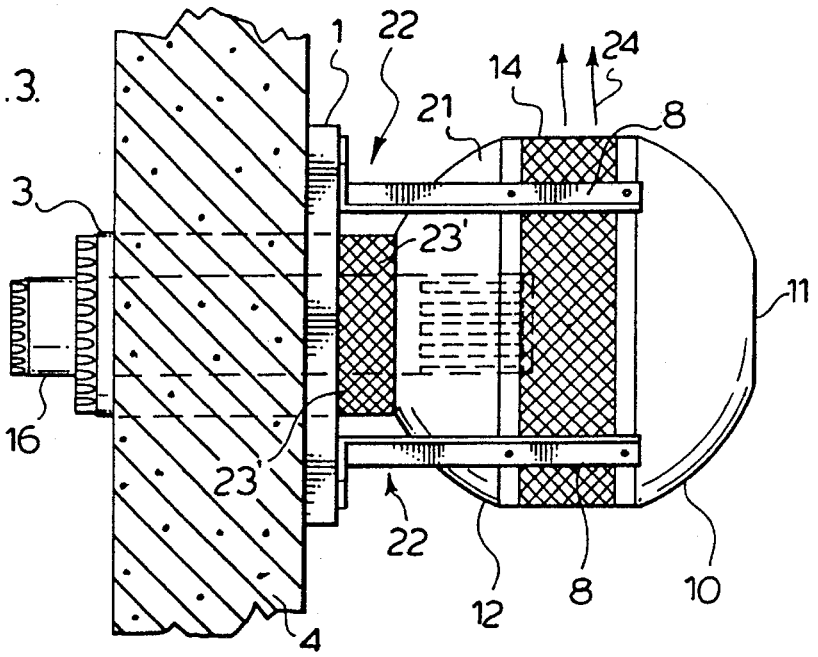
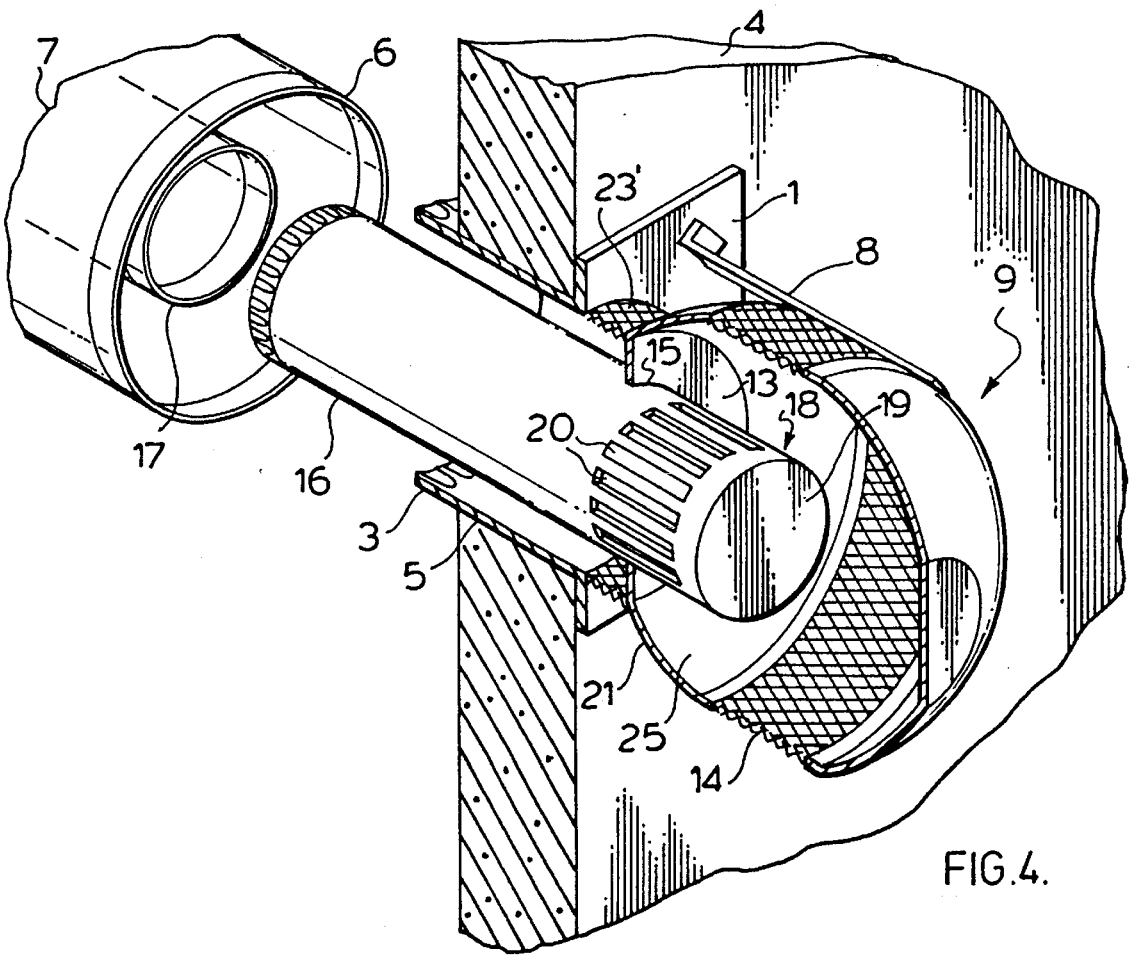
FIG. 4.

TERMINATION DEVICE FOR HORIZONTAL DIRECT VENT GAS FIREPLACES OR THE LIKE

FIELD OF THE INVENTION

This invention relates to termination devices to be mounted on the outside of an exterior wall for providing a through the wall connection to the double walled coaxial ducting of direct vented gas fireplaces or the like in which an inner duct carries away the products of combustion and an outer duct takes in combustion air.

BACKGROUND OF THE INVENTION

At present, the usual termination devices are generally square and have outwardly directed deflecting surfaces extending along their sides outwardly of the mouth of the combustion air intake pipe to protect against the effects of strong winds. It has been found, however, that there is a serious problem with the present termination devices when there are winds having a velocity in the range of 5 to 15 kilometers per hour. In such circumstances, the flame becomes unstable and eventually goes out because the air intake becomes reversed and the air required to support combustion in the firebox is lacking.

This lack of combustion air appears to be a result of the hot exhaust fumes heating air in the intake duct causing an outward air flow aided by any venturi effect or reduction of atmospheric pressure due to vortexes and wakes in the intake region at the mouth of the intake duct reversing air intake at these low velocity winds.

SUMMARY OF THE INVENTION

According to one aspect of the present invention, there is provided a termination device having an air deflector arrangement associated with a combustion air intake pipe which has been found effective to direct adequate combustion air into the intake pipe and into the outer duct of a connected double walled coaxial ducting under all wind conditions from 0 to 95 kilometers per hour to maintain a stable flame in the direct vent gas fireplace or the like to which the double walled ducting is connected.

Further, according to another aspect of the invention, there is provided a novel exhaust system for connection to the inner duct of the double walled ducting to effect a more efficient dispersion of the exhaust fumes into the atmosphere.

More particularly, according to one aspect of the invention, there is provided a termination device of the type described comprising a mounting means having an opening therethrough for mounting said device on the exterior of a wall having a passage therethrough with said opening registering with said passage, a first pipe adapted for connection with the outer combustion air carrying duct of a fireplace double walled ducting secured to said mounting means and projecting inwardly thereof and adapted to extend through said wall passage, deflector means supported in spaced relation outwardly from the mouth of said first pipe and presenting an air deflecting surface formation surrounding and sloping inwardly towards the mouth of said first pipe to a central opening in substantially coaxial relation with but spaced from said first pipe, said air deflecting surface formation being adapted to deflect air inwardly into said first pipe, a second pipe adapted for connection with the inner exhaust carrying duct of said double walled ducting extending from an outer end located on the outer side of said deflecting surface formation inwardly through said deflecting surface central opening and through said first pipe, means to bar the entrance of foreign objects into the mouth of said first pipe while permitting airflow therethrough, and protective means surrounding the end of said second pipe to bar access thereto while permitting the escape of exhaust fumes.

According to another aspect of the invention, the second pipe ends in a cap having a series of openings around the perimeter thereof and the means surrounding said second pipe comprises a generally spherical chamber having a central band of screening for exiting exhaust fumes emanating from said cap openings and circulated thereto by said spherical chamber.

According to the preferred form of the invention, the outer surface of the inward portion of the generally spherical exhaust chamber forms the deflecting surface for deflecting combustion air into the outer pipe.

BRIEF DESCRIPTION OF THE DRAWINGS

FIG. 3 is a side view of a device similar to FIG. 1 but having a different screen mesh arrangement to block entrance to the air intake pipe and showing it mounted to an exterior wall;

FIG. 4 is an enlarged broken away perspective view illustrating an installation of the termination device ready for connection to a conventional double walled ducting leading from a direct vent gas fireplace or the like to the termination device;

DETAILED DESCRIPTION OF THE PREFERRED EMBODIMENTS

Figure 1:
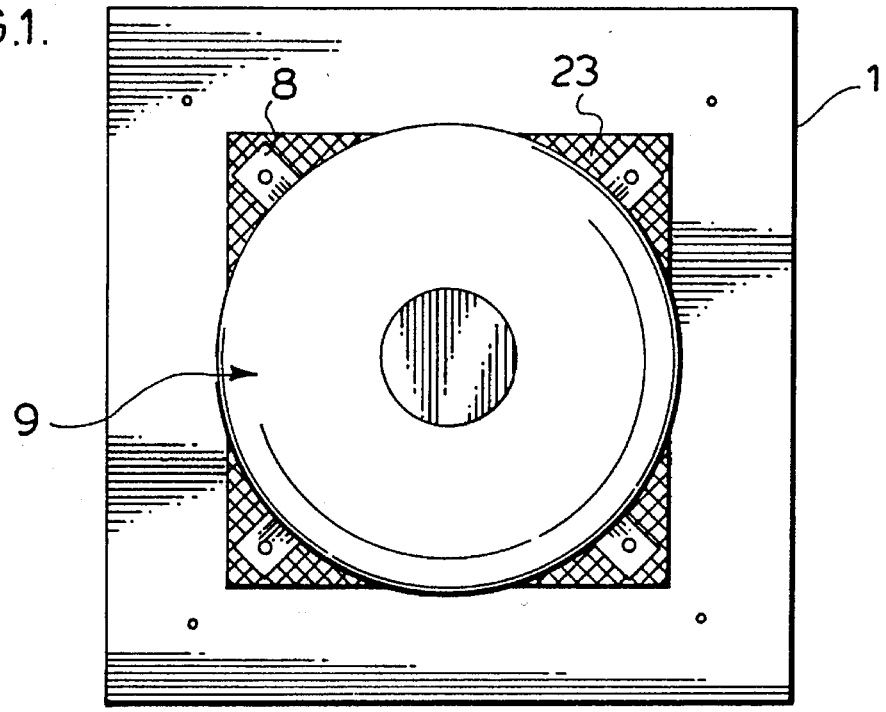
FIG. 1 is an end view of a termination device embodying the invention.
Figure 2:
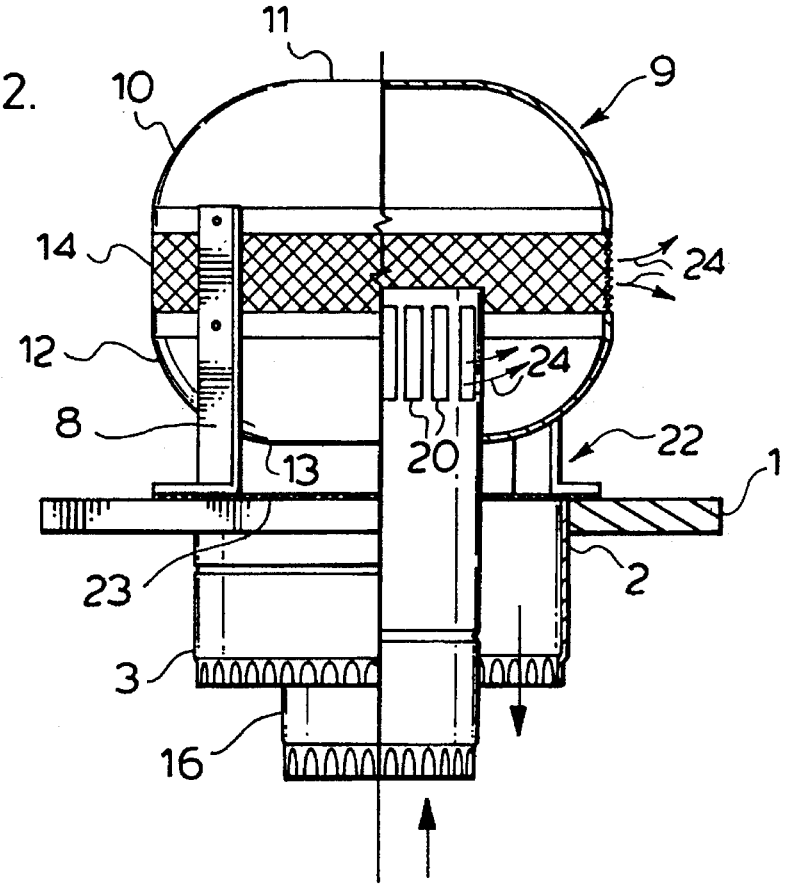
FIG. 2 is a part broken away plan view of the device of FIG. 1.

With reference to FIGS. 1 and 2, according to the preferred form of the invention the termination device comprises a mounting plate 1 having a circular opening 2 therethrough in which is mounted an outer pipe member 3 which projects inwardly relative to the mounting plate 1 when same is mounted to the exterior of a wall 4, as shown in FIGS. 3 and 4, to extend through a passage 5 through the wall for connection to the outer duct 6 of a double walled or coaxial ducting generally designated at 7.

Supported outwardly in spaced relation from the mounting plate 1 by legs 8 is a generally spherical exhaust chamber 9 comprised of an outer dish member 10 having a flattened bottom 11 facing outwardly away from said mounting plate 1 and an inner annular dish member 12 having its bottom 13 facing inwardly towards said mounting plate 1 but spaced therefrom. The dish members 10 and 12 are spaced apart by a circular, preferably steel, mesh band 14 having a 40 to 80% open area which bars access to the interior of the exhaust chamber 9 by rodents, birds, leaves or other foreign objects or material. This central band of screening also provides an air flow passage for air flow transversely through the exhaust chamber to reduce the effect of the wakes or vortexes which tend to impede the outward flow of the exhaust products. This reduction of turbulence is sufficiently close to the mouth of the outer combustion air intake pipe 4 that it also assists in the combustion air intake.

The inner annular dish member 12 has a central circular opening 15 in the bottom thereof smaller than the diameter of the outer pipe 3 but substantially concentric or coaxial therewith. An inner pipe 16 extends inwardly from the interior of the exhaust chamber 9 and through the outer pipe 3 and is adapted for connection to the inner duct 17 of the double walled ducting 7.

The inner pipe 16 ends in a cap 18 closed at the end 19 and provided with a plurality of slots 20 around the perimeter thereof.

The double walled ducting such as illustrated at 7 for example for typical direct vented fireplaces comes in various forms either rigid or flexible and typically the inner duct 17 would usually have a diameter of 4 inches and the outer duct 6 would have diameters of 6 to 8 inches.

In a practical example for such an installation, to match a double walled ducting having a 4 inch diameter inner duct and an 8 inch diameter outer duct, the termination device of the invention would have a 4 inch diameter inner pipe 16 and an 8 inch diameter outer pipe 3. With the diameters of the dishes 10 and 12 of the order of 10 inches and the spacing between the bottom of the inner dish 12 from the plate 1 and mouth of the outer pipe 3 of the order of 2 inches excellent results have been recorded. It will be understood however that the dimensions will depend on the size of the double walled ducting, and it is not intended to limit the invention to the specified dimensions of the example given and variations therein may be made as will be understood by those skilled in the art without departing from the principles of the invention.

As will be seen in FIGS. 2 to 4, the surface 21 of the inner annular dish member 12 which faces inwardly towards the mounted plate 1 provides a deflecting surface leading inwardly towards the mouth of the outer pipe 3 to provide an annular convergent passage 22 into which the deflector surface 21 is adapted to deflect airflow into the mouth of the outer pipe 3 around the inner pipe 16.

In the preferred embodiment disclosed, this inwardly facing deflector surface 21 is of convex form for minimal air turbulence.

It will be understood that it is necessary to prevent rodents, birds, leaves or other foreign materials from entering the outer pipe 1. This may be accomplished by the use of suitable flat steel screen mesh or the like 23 extending over the entrance to the outer pipe 1 and surrounding the inner pipe 16 as shown in FIGS. 1 and 2.

Alternately as shown in FIGS. 3 and 4 an annular screen mesh 23' closing off the passage 22 may be employed and, if desired, suitable screening both closing off passage 22 and also encasing the entire exhaust chamber may be employed.

The generally spherical shape of the exhaust chamber 9 has been found to effect a more efficient exhausting of the fumes 24 exiting out the cap slots 20 so that they are guided with minimal turbulence out through the central mesh band 14 and as explained this circular mesh band provides an air passage through the exhaust chamber to reduce the effect of air vortexes and wakes in the region.

In effect, the inner annular dish member 12 provides a double function in that the outside inwardly facing surface 21 thereof defines with the mounting plate 1 the convergent passage 22 which improves flow characteristics allowing air to be deflected into the intake outer pipe 3 while the inside surface 25 thereof assists in circulating the products of combustion to the discharge area constituted by the circular mesh 14.

The improved air flow characteristics provided by the present termination device have been found to provide the requisite combustion air intake at all wind speeds up to 95 kilometers per hour to maintain an essentially steady flame in a direct vent gas fireplace and the generally spherical exhaust chamber 9 has been found to provide for efficient exhausting of the products of combustion.

While the preferred form of the invention has been particularly described, it will be understood that variations may be made therein as will be apparent to those skilled in the art without departing from the scope of the appended claims.

The embodiments of the invention in which an exclusive property or privilege is claimed are defined as follows:

1. A termination device for a through the wall connection to the double walled coaxial ducting having inner and outer coaxial ducts of a horizontal direct vented gas fireplace comprising a mounting means having an opening therethrough for mounting said device on the exterior of a wall having a passage therethrough with said opening registering with said passage, a first combustion air intake pipe adapted for connection with the outer of said coaxial ducts secured to said mounting means and projecting inwardly thereof and adapted to extend through said wall passage, deflector means supported in spaced relation outwardly from the mouth of said first pipe and presenting a generally convex annular air deflecting surface formation facing and sloping inwardly towards the mouth of said first pipe to a central opening in substantially coaxial relation with but spaced from the mouth of said first pipe, said air deflecting surface formation being adapted to deflect air inwardly into said first pipe, a second exhaust pipe adapted for connection with the inner of said coaxial ducts extending from an outer end located on the outer side of said deflecting surface formation inwardly through said deflecting surface formation central opening and through said first pipe, means to bar the entrance of foreign objects into the mouth of said first pipe while permitting airflow therethrough, and protective means surrounding the outer end of said second pipe to bar access thereto while permitting escape of exhaust fumes.

2. A termination device as claimed in claim 1 in which said second pipe ends within said protective means in a cap having a closed end and a series of openings around the periphery thereof.

3. A terminating device as claimed in claim 1 in which said protective means surrounding said second pipe comprises a generally spherical chamber having a central band of screening for outletting exhaust products, the portion of said chamber facing said mounting plate constituting said deflecting surface formation.

4. A termination device for providing a through the wall termination for the coaxial ducting of a horizontal direct vent gas fireplace, said coaxial ducting having an outer duct for incoming combustion air and an inner duct for exhaust fumes, said termination device comprising a base plate for mounting same to an exterior wall and having a circular opening therethrough, a first pipe secured in said base plate opening and extending inwardly for insertion through an opening in the exterior wall and adapted for connection to said outer duct, an exhaust chamber mounted in spaced relation to said base plate and comprising a pair of oppositely facing dishes supported in spaced relation, one of said dishes comprising an inner annular dish having its bottom facing said plate, said inner annular dish being provided with a central circular opening smaller than and substantially coaxial with said first pipe, the other of said dishes being an outer dish having its bottom facing away from said plate, a second pipe smaller than said first pipe and substantially coaxial therewith mounted to extend inwardly from within said exhaust chamber through said inner dish central opening and through said first pipe for termination interiorly of the exterior wall, said inner pipe being adapted for connection to said inner duct, a cap on said inner pipe within said exhaust chamber, said cap having a closed end and peripheral openings adjacent said closed end, the spacing of said dishes providing a peripheral discharge opening therebetween, a protective screen coveting said peripheral discharge opening to bar access to said exhaust chamber, said inner dish and said plate forming a convergent peripheral combustion air intake passage leading to the mouth of said first pipe and a protective screen means to bar the ingress of foreign objects into the mouth of said first pipe.

5. A termination device as claimed in claim 4 in which said protective screen covering said peripheral discharge opening between said inner and outer dishes has from 40 to 80% open space to provide for air flow through said exhaust chamber.

6. In a termination device for connection to the coaxial ducting having coaxial inner and outer ducts of a direct vented gas fireplace, said device having a mounting means provided with an opening therethrough for securing said device to an exterior wall having a passage therethrough with said mounting means opening in registration with the wall passage, a first pipe member extending inwardly from said mounting means adapted to provide a through the wall connection for said outer duct of said coaxial ducting, an exhaust chamber supported from said mounting means and spaced outwardly therefrom, a second pipe smaller than said first pipe extending inwardly from within said exhaust chamber and inwardly through said mounting means opening within said first pipe, said second pipe being adapted for connection to said inner duct of said coaxial ducting, said exhaust chamber presenting an annular convex deflector surface facing but spaced from said mounting means and surrounding said second pipe, said, deflector surface sloping inwardly towards said mounting means to direct air inwardly into said first pipe.

* * * * *